US012782063B2

(12) United States Patent
Aste et al.

(10) Patent No.: US 12,782,063 B2
(45) Date of Patent: Nov. 3, 2026

(54) PLATE HEAT EXCHANGER WITH HOLLOWED-OUT PLATE(S)

(71) Applicant: COMMISSARIAT A L'ENERGIE ATOMIQUE ET AUX ENERGIES ALTERNATIVES, Paris (FR)

(72) Inventors: Fabio Aste, Grenoble (FR); Bertrand Chandez, Grenoble (FR); Hai Trieu Phan, Grenoble (FR)

(73) Assignee: COMMISSARIAT À L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 112 days.

(21) Appl. No.: 18/828,908

(22) Filed: Sep. 9, 2024

(65) Prior Publication Data

US 2025/0085065 A1 Mar. 13, 2025

(30) Foreign Application Priority Data

Sep. 8, 2023 (FR) ..... 2309503

(51) Int. Cl.
*F28F 3/08* (2006.01)
*F28D 9/00* (2006.01)

(52) U.S. Cl.
CPC ..... *F28F 3/086* (2013.01); *F28D 9/0075* (2013.01); *F28D 9/0093* (2013.01); *F28F 2230/00* (2013.01)

(58) Field of Classification Search
CPC ..... F28D 9/0075; F28D 9/0093; F28F 3/086; F28F 9/0265; F28F 2230/00
See application file for complete search history.

(56) References Cited

U.S. PATENT DOCUMENTS 2,379,671 A * 7/1945 Wetherby-Williams ..... F28F 3/083 165/76
2,582,871 A 1/1952 Kintner
4,815,534 A * 3/1989 Fuerschbach ..... F28F 13/12 165/166

(Continued)

FOREIGN PATENT DOCUMENTS

CN 104748605 A 7/2015
CN 111780597 A 10/2020

(Continued)

*Primary Examiner* — Eric S Ruppert
*Assistant Examiner* — Hans R Weiland
(74) *Attorney, Agent, or Firm* — Oliff PLC

(57) ABSTRACT

A heat exchanger including: first and second heat-exchange modules comprising fluid-circulation systems, partition plates which fluidically disconnect adjacent fluid-circulation systems, at least one of the heat-exchange modules including: a frame plate of constant thickness, including a through-aperture, and an insert fully housed in the aperture and of a thickness equal to the thickness of the frame plate, and consisting of a single shaped plate or a plurality of shaped plates forming a stack and each consisting of at least one hollowed-out zone passing through it and a surrounding solid zone of constant thickness, the corresponding fluid-circulation system being formed in the hollowed-out zone of the single plate or of each plate of the stack and bounded by the surrounding solid zone or zones and by the adjacent partition plates.

15 Claims, 11 Drawing Sheets

(56) References Cited

U.S. PATENT DOCUMENTS

| | | | | |
|---|---|---|---|---|
| 5,392,849 | A * | 2/1995 | Matsunaga | F28D 9/0075 165/167 |
| 6,959,492 | B1 * | 11/2005 | Matsumoto | F28D 9/0075 29/890.039 |
| 7,121,331 | B2 * | 10/2006 | Yoshida | F28F 3/027 165/170 |
| 2024/0418457 | A1 * | 12/2024 | Emmerich | F28F 3/08 |

FOREIGN PATENT DOCUMENTS

| | | | |
|---|---|---|---|
| EP | 0183008 | A1 | 6/1986 |
| FR | 2184536 | A1 | 12/1973 |

* cited by examiner

PLATE HEAT EXCHANGER WITH HOLLOWED-OUT PLATE(S)

This application claims priority based on French Patent Application No. 2309503 filed on Sep. 8, 2023. The disclosure of the prior application is hereby incorporated by reference herein in its entirety.

TECHNICAL FIELD

The present invention relates to the field of the exchange of heat between fluids, particularly with a fluid separation within at least one of the fluids.

PRIOR ART

In order to optimize the output of an installation involving an energy conversion, particular attention is paid to the heat exchanger that makes up this installation.

Increasing the thermal efficiency of a heat exchanger has a direct effect on the performance of the thermodynamic cycle of the installation, by reducing the primary energy consumption of the latter and, as a result, reducing the corresponding emissions and supply costs.

In general, the objective of optimizing the performance of a heat exchanger is achieved by adopting complex solutions in which the original geometry of the component is specifically tailored to the specific application for which the installation is intended. The adoption of such solutions is expensive and limits the potential to reuse the exchanger for other applications.

Furthermore, the increasing scarcity of raw materials, due to increasing consumption and the exhausting of existing deposits, is a driving force behind designing heat exchangers using very little material while maintaining or improving their performance.

Moreover, when a phase-separation in one of the fluids during the exchange of heat is sought, thermodynamic interactions may occur within the exchanger. It may then be necessary for the heat exchanger design to focus on optimizing either the exchange of heat or the mass transfer.

Concentric-tubes, tube-bundle, serpentine-coil, plate, hybrid or finned heat exchangers are known. The heat exchangers most widely used, because of the excellent heat exchange coefficients they are able to achieve, are plate-type heat exchangers.

Plate heat exchangers may be of the brazed or welded type or of the gasketed type.

Welded plate exchangers are one-piece units since the plates can no longer be detached after welding. Conversely, gasketed plate exchangers can be dismantled and then lengthened or shortened as needed, allowing these to be adapted to suit the desired application and facilitating exchanger maintenance.

The flow of the fluids in the heat exchanger may be monophasic or biphasic. In the case of biphasic flow, the heat exchange benefits from a condition that is highly favorable, because the change in phase generally occurs at a constant temperature: the logarithmic temperature difference therefore increases considerably, reducing the exchange area needed.

There are other parameters that influence the performance of plate exchangers.

The two fluids are separated by a partition plate, generally made of metal. The thermal conductivity of the partition plate introduces resistance to the heat transfer, which resistance can be reduced by reducing the thickness of the plate or by using a partition plate made from a metal that has high thermal conductivity, for example copper or aluminum rather than steel.

Turbulence in the fluid-circulation systems for each fluid (distribution chamber, collecting chamber, exchange channels, etc.) is generally sought-after because it increases the thermal efficiency of the exchanger.

Finally, optimal spatial distribution of the fluid-circulation systems also improves the exchange of heat.

U.S. Pat. No. 5,392,849 A for example describes a stacked-plates plate exchanger with countercurrent flow of the two fluids. It comprises solid plates alternating with indented plates in which the fluid is distributed, flows and is collected before being discharged from the exchanger.

CN 104748605 A describes a plate exchanger with microchannels. The exchange of heat benefits from a magnetic field generated by electrodes inserted into a plate.

CN 111780597 A describes a vacuum diffusion welded plate exchanger suitable for crossflow movement of the fluids.

There is therefore still a need for a heat exchanger suitable for efficient exchange of heat, the design of which can easily be adapted to suit the application for which the installation in which the exchanger is incorporated is intended, and which is optionally suitable for bringing about a phase separation within at least one of the fluids within it.

SUMMARY OF THE INVENTION

The invention proposes a heat exchanger comprising, superposed longitudinally on one another:

- a plurality of first and second heat-exchange modules in which first and second fluid-circulation systems are formed, for circulating first and second fluids respectively, and
- a plurality of partition plates each sandwiched between adjacent first and second heat-exchange modules and in contact with the adjacent first and second heat-exchange modules, each partition plate fluidically disconnecting the first and second fluid-circulation systems from one another.

According to a first main aspect of the invention, at least one of the first and second heat-exchange modules comprises:

- a frame plate, of constant thickness, comprising an aperture passing through its entire thickness, and
- an insert fully housed in the aperture and of a thickness equal to the thickness of the frame plate, the insert consisting of
  - a) a shaped plate consisting of at least one hollowed-out zone passing through the entire thickness of the shaped plate and of a surrounding solid zone of constant thickness, the corresponding fluid-circulation system being formed in the hollowed-out zone and bounded transversely by the surrounding solid zone and longitudinally by the partition plates adjacent to said module, or
  - b) a stack of shaped plates, at least one and preferably each of the shaped plates consisting of at least one hollowed-out zone passing through the entire thickness of the shaped plate and of a surrounding solid zone of constant thickness, the corresponding fluid-circulation system being defined by the hollowed-out zones of the stack and bounded transversely by the surrounding solid zones and longitudinally by the partition plates adjacent to said corresponding heat-exchange module.

The exchanger according to the first main aspect of the invention can easily be adapted to suit the application for which it is intended. Furthermore, it is easy to maintain. The frame plate defines a housing in which the different types of shaped plates or stacks of shaped plates can be housed. Thus, a worn-out shaped plate can be replaced while keeping the frame plate in place if this latter plate is still in good working order. Moreover, when the exchanger needs to be integrated into an installation the application of which is different than that initially envisioned, it is possible to design a shaped plate or a stack of shaped plates having a fluid-circulation system of a form specifically designed for that application, without the need to modify the partition plate and/or the frame plate.

Moreover, the shaped plate or the stack of shaped plates may be obtained using cutting techniques that are simpler to implement and less expensive than the machining or pressing techniques usually employed for producing the heat exchangers of the prior art.

In the variant in which the insert is a stack of shaped plates, each shaped plate is of lesser thickness than the frame plate. For example, each shaped plate has a small thickness, enabling optimal heat transfer, without it being required to contribute to the mechanical strength of the heat exchanger, that function being provided by the frame plate of greater thickness.

Unless mentioned otherwise, the thickness of a component, for example a heat-exchange module or plate, is defined and measured along the longitudinal axis of the heat exchanger.

As a preference, the contour of the aperture and the exterior contour of the insert, in at least a transverse plane of section, are homothetic with respect to one another, so as to facilitate assembly of the heat-exchange module during heat-exchanger manufacture or maintenance.

As a preference, the heat exchanger has a groove separating the frame plate and the insert from one another, the width of the groove preferably being constant. The groove may completely encompass the periphery of the insert.

As a preference, the heat exchanger comprises a seal, preferably an O-ring, placed in the groove and which is compressed by the adjacent partition plates. This then improves the sealing between the partition plates and the corresponding heat-exchange module, thereby reducing the risk of leaks of fluid. Furthermore, the seal can easily be removed when replacing or changing the insert.

The seal may be extruded or overmolded. It may be made from a polymer material, for example selected from ethylene propylene diene monomer (EPDM) or polytetrafluoroethylene (PTFE). It may have a Shore hardness of between 70 and 80.

As a variant, the insert may be fixed, for example bonded, brazed or welded, notably using diffusion welding, to the frame plate.

The frame plate and the shaped plate or plates may be made of different materials. For example, it is possible to select a material that offers poor mechanical properties but good thermal properties from which to make the shaped plate or plates.

In particular, the frame plate may be made of a material that has an elastic modulus and/or a breaking strength that are higher than the elastic modulus and/or the breaking strength, respectively, of the material used to make the shaped plate or plates. Thus, the frame plate makes a greater contribution to the stiffness and/or mechanical strength of the exchanger than does the insert.

The solid zone of the or each shaped plate and the frame plate may have different surface roughnesses.

The frame plate and/or the shaped plate or plates may be made of metal, for example of steel, notably a stainless steel, or based on aluminum, on copper or on titanium.

The shaped plate or plates may comprise a material that catalyzes a chemical reaction on contact with a component of the first and/or of the second fluid.

Since the frame plate has the notable function of providing the spacing between two consecutive partition plates, it may have a low thermal conductivity, for example less than 50 $W \cdot m^{-1} \cdot K^{-1}$, in order to avoid contributing to the heat transfer.

Moreover, the second heat-exchange module may comprise a third fluid-circulation system fluidically disconnected from the second fluid-circulation system, the second and third fluid-circulation systems being defined by different portions of the hollowed-out zone or zones of the corresponding insert. Advantageously, the one same insert may define different and separated flow zones for different fluids.

As a variant, the second heat-exchange module may comprise a third fluid-circulation system fluidically disconnected from the second fluid-circulation system, the corresponding frame plate comprising a second aperture in which there is placed a second insert which bounds the third fluid-circulation system.

Moreover, according to a second main aspect of the invention, at least one of the first and second heat-exchange modules comprises:

- a stack of shaped plates superposed on one another along a longitudinal axis, each shaped plate consisting of at least one hollowed-out zone passing through the entire thickness of the shaped plate and of a surrounding solid zone of constant thickness, the corresponding fluid-circulation system being defined by the hollowed-out zones of the stack and extending longitudinally between the partition plates adjacent to the corresponding heat-exchange module,
- at least part of the hollowed-out zone of one of the shaped plates of the stack being superposed with a solid zone of another shaped plate adjacent to it in the stack, and vice versa.

The heat exchanger according to the second main aspect of the invention thus defines, by a simple stacking of the shaped plates between two adjacent partition plates and in the plane and/or in the thickness of the stack, a fluid-circulation system of complex two-dimensional or, for preference, three-dimensional shape.

Unlike in the prior art, where it requires machining that is complex and expensive, or even impossible to obtain, according to the invention, such a fluid-circulation system can be obtained easily and at low cost because the shaped plates are, as mentioned above, easy to manufacture. The invention furthermore overcomes the limitations encountered in pressed plate exchangers of the prior art where the channels have a geometry that is defined by the shape of the pressed reliefs.

As a preference, the fluid-circulation system has, in at least a longitudinal plane of section, different profiles at least at two different positions along the transverse axis of said plane of section, which is perpendicular to the longitudinal axis.

In particular, the profile at a position along said transverse axis may comprise the rank of the hollowed-out zone or zones in the stack and/or the height of the fluid-circulation system at said position and/or the number of hollowed-out zones at said position.

The fluid-circulation system may comprise portions extending along different axes. It may comprise at least two portions which extend along axes contained in a transverse plane and which are different than one another. It may comprise at least two portions which extend along axes contained in a longitudinal plane and which are different than one another.

A longitudinal plane contains the longitudinal axis. A transverse plane is defined by two transverse axes which are each perpendicular to the longitudinal axis. A transverse plane is therefore perpendicular to a longitudinal plane.

The fluid-circulation system may comprise at least a main path which splits upstream into a plurality of secondary paths which recombine downstream. Thus, the fluid circulating in the fluid-circulation system may follow different paths inside the corresponding heat-exchange module. This makes it possible to vary the fluidic conditions of the flow by changing the shape of the passage cross section of the fluid-circulation system along its route. It is thus possible to generate phase separation within each secondary path and/or auto-equalization of the fluid pressures and/or flow rates between the secondary paths.

The fluid-flow system may comprise, when observed in a longitudinal plane of section, a meandering portion extending between the adjacent partition plates.

The length and/or the width of the shaped plates and of the partition plates may be equal.

According to a third main aspect of the invention, the first fluid comprises different first and second fluid components, and each partition plate longitudinally bounds the circulation system of the heat-exchange module with which said partition plates are in contact. Each of the second heat-exchange modules further comprises a third fluid-circulation system, fluidically disconnected from the second fluid-circulation system, the first and third fluid-circulation systems being fluidically connected through the corresponding partition plate, the heat exchanger being configured to introduce a change in phase of the second fluid component under the effect of the exchange of heat between the first and second fluids, and to direct the flow of the first fluid component out of the exchanger through the first fluid-circulation system, and the flow of the second fluid component out of the exchanger through the third fluid-circulation system.

The heat exchanger according to the third main aspect of the invention offers the advantage of great compactness, the heat exchange and the phase separation occurring within the first and second heat-exchange modules.

As a preference, the exchanger comprises a supply duct for the first fluid-circulation system, opening into an inlet opening for the first fluid and a discharge duct for the first fluid opening into an outlet opening for the first fluid, the third fluid-circulation system being closer to said inlet opening for the first fluid than to the outlet opening for the first fluid. When the first fluid is colder entering the first heat-exchange module than leaving same, the third fluid-circulation system is then closer to the coldest zone of the first heat-exchange module, thereby facilitating the cooling and, for example, the liquefaction, of the second fluid component.

As a preference, the exchanger is configured so that the second fluid component, having changed state, flows countercurrent to the first fluid in the first fluid-circulation system in the direction of the third fluid-circulation system. For example, the second fluid component, which has changed from the liquid state to the gaseous state under the effect of the exchange of heat with the second fluid, flows in the gaseous state counter to the flow of the first fluid which contains the second liquid component in the liquid state.

The heat exchanger preferably comprises a discharge duct for the third fluid-circulation system in order to expel the second fluid component from the exchanger.

According to one variant, at least one of the first and second heat-exchange modules consists of a shaped plate consisting of at least one hollowed-out zone passing through the entire thickness of the shaped plate and of a surrounding solid zone of constant thickness, the first fluid-circulation system on the one hand or, on the other hand, the second fluid-circulation system and/or the third fluid-circulation system being formed respectively in the hollowed-out zone and bounded transversely by the surrounding solid zone and longitudinally by the partition plates adjacent to said module.

According to another variant, at least one of the first and second heat-exchange modules consists of a frame plate of constant thickness comprising an aperture passing through its entire thickness, and an insert fully housed in the aperture and of a thickness equal to the thickness of the frame plate, the insert consisting of a) a shaped plate consisting of at least one hollowed-out zone passing through the entire thickness of the shaped plate and of a surrounding solid zone of constant thickness, the first fluid-circulation system or the second fluid-circulation system and/or the third fluid-circulation system being formed in the hollowed-out zone and bounded transversely by the surrounding solid zone and longitudinally by the partition plates adjacent to said module, or b) a stack of shaped plates, at least one and preferably each of the shaped plates consisting of at least one hollowed-out zone passing through the entire thickness of the shaped plate and of a surrounding solid zone of constant thickness, the first fluid-circulation system on the one hand or, on the other hand, the second fluid-circulation system and/or the third fluid-circulation system being defined respectively by the hollowed-out zones of the stack and bounded transversely by the surrounding solid zones and longitudinally by the partition plates adjacent to said module.

The features of the various main aspects of the invention, optional or otherwise, together with the optional features set out above and those of the description which follows may be combined with one another.

As a preference, whatever the main aspect of the invention considered, the heat exchanger may comprise one or more of the following optional features.

The first and second heat-exchange modules are preferably arranged alternately one after the other along the longitudinal axis.

As a preference, the hollowed-out zone is formed by cutting.

As a preference, it is formed by laser cutting, waterjet cutting or by punching. As a preference, the hollowed-out zone is formed by laser cutting.

The first and second fluid-circulation systems are preferably bounded longitudinally by the partition plates which sandwich the respectively adjacent first and second heat-exchange modules and which are in contact with said first and second heat-exchange modules, respectively.

At least one and preferably each of the first, second and, where applicable, third, fluid-circulation systems comprises at least one channel, preferably a plurality of channels, and/or a fluid distribution chamber for supplying fluid to the channel or channels and/or a collecting chamber into which the channel or channels open at their downstream end.

The channels may run parallel to one another, for example parallel to the length of the insert. As a variant, the channel or channels may form a serpentine extending in the median plane of the insert.

The shaped plate or plates and/or the partition plate and/or the frame plate are preferably planar and have parallel faces.

The partition plate may have a thickness less than or equal to 2.0 mm, so as to maximize heat exchanges, and optionally greater than or equal to 0.5 mm.

The partition plate may have a roughness suitable for facilitating establishing turbulent flow in the first fluid or the second fluid.

The frame plate may have a thickness of between 1 and 10 mm.

As a preference, each shaped plate of the stack may have a thickness less than 3 mm, or even less than 2 mm, or even less than 1 mm.

The shaped plates may have identical thicknesses.

The stack may comprise at least two identical shaped plates. As a preference, the identical shaped plates are each asymmetrical, one of the shaped plates being arranged symmetrically with the other shaped plate, with respect to a longitudinal plane.

What is meant by "asymmetrical" is that a plate has at most one single longitudinal plane of symmetry. Thus, an asymmetrical plate may be symmetrical with respect to a transverse median plane.

In a variant, at least two shaped plates of the stack are different.

The stack may comprise more than two, or even more than five, or even more than ten shaped plates. A high number of shaped plates makes it possible to refine the shape of the fluid-circulation system.

The partition plate on the one hand and, on the other hand, the shaped plates and/or, where applicable, the frame plate, may be made from different materials.

As a preference, the partition plates have a thickness less than the thickness of each of the first heat-exchange modules and/or than the thickness of each of the second heat-exchange modules.

As a preference, the exchanger comprises end plates placed longitudinally at the ends of the exchanger and which sandwich the plurality of first and second heat-exchange modules and the plurality of partition plates.

As a preference, one and/or the other of the end plates comprises an inlet opening for the first fluid and/or an outlet opening for the first fluid and/or an inlet opening for the second fluid and/or an outlet opening for the second fluid and/or, where applicable, an outlet opening for the second fluid component.

As a preference, the first heat-exchange modules are all identical and/or the second heat-exchange modules are all identical. This facilitates heat-exchanger manufacture and maintenance.

The heat exchanger may be of the welded type. In particular, the first heat-exchange modules and/or the second heat-exchange modules may be welded to the partition plates.

According to a preferred variant, the heat exchanger is of the "gasketed" type, which makes it easier to maintain, for example by replacing only all those partition plates, shaped plates or frame plates that have worn out.

As a preference, the heat exchanger comprises a compression means for compressing the first and second heat-exchange modules and the partition plates so as to seal each of the first, second and, where applicable, third, fluid-circulation systems. The end plates may be equipped with pierced holes and the exchanger comprises connecting rods engaged through the pierced holes and connecting the end plates. The connecting rods are bolted to the end plates and compress said superposed assembly.

The invention also relates to a heat transfer method comprising

- the provision of the heat exchanger according to the third main aspect of the invention,
- the circulation of a first fluid and of a second fluid in the first and second fluid-circulation systems, the first fluid comprising first and second fluid components,
- the exchange of heat between the first and second fluids and the change in phase of the second fluid component as a result of the heating or of the cooling of the first fluid during the exchange of heat,
- the outflow of the second fluid component from the heat exchanger through the third fluid-circulation system.

As a preference, the second fluid component, the state of which has changed as a consequence of the change in phase, flows countercurrent to the flow of the first fluid in the first fluid-circulation system.

The method may include cooling the second fluid component after the third fluid flow has left and before the second fluid component flows out of the heat exchanger.

As a preference, the first fluid is introduced in the liquid state into the first fluid-circulation system, and the second component is in the gaseous state after the change in phase under the effect of the heating of the first fluid by heat transfer with the second fluid. The first fluid component is preferably kept in the liquid state as it flows in the first fluid-circulation system.

In particular, the first fluid component may be water and the second fluid component may be ammonia. The second fluid may be water, notably glycol-water, or oil.

The first fluid and the second fluid may flow countercurrent in the first and second fluid-circulation systems, so as to maximize the exchange of heat between them.

The invention also relates to a thermodynamic installation comprising an exchanger according to the invention, notably according to the third aspect of the invention.

Finally, it relates to the use of the thermodynamic installation according to the invention for:

- separating phases of the second component by evaporation, for example in the petrochemical field, or
- separating phases of the second component by condensation, for example in the gasification field, or
- exchange of mass, notably by adsorption/desorption, coupled with heat exchange.

BRIEF DESCRIPTION OF THE DRAWINGS

The invention will be able to be better understood upon reading the following detailed description of non-limiting exemplary implementations thereof, and upon examining the appended drawing, in which.

In the attached drawings, and for the sake of clarity, the true proportions of the various constituent elements or the spacings between them have not always been adhered to. Moreover, and for the sake of clarity, certain elements may not have been depicted as being in contact with one another even though they are in practice in contact.

DETAILED DESCRIPTION

Figure 1:
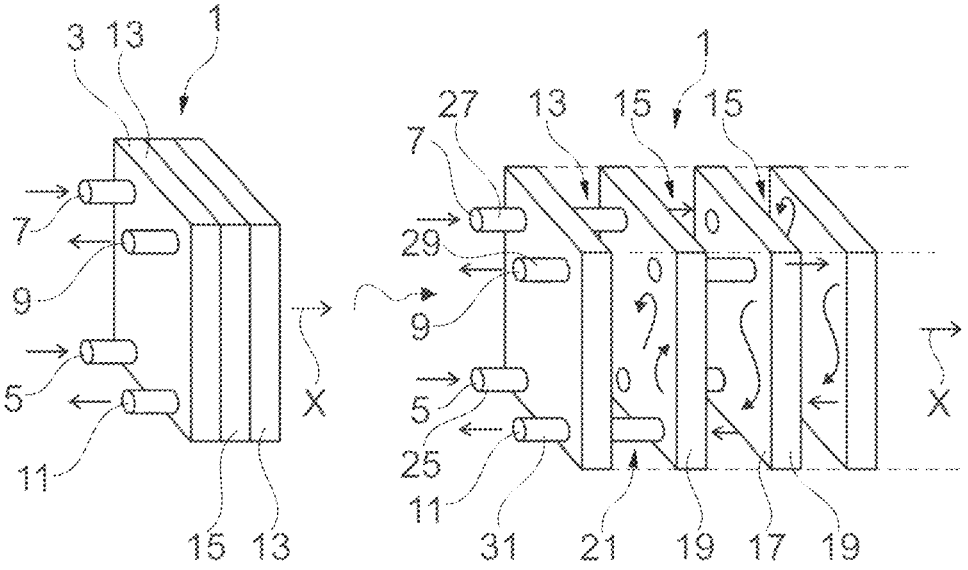
FIG. 1 schematically depicts a) a plate heat exchanger, and b) an exploded view of the exchanger.

FIG. 1 schematically illustrates an example of a plate heat exchanger 1, notably that of the invention. This exchanger is intended for the exchange of heat between two fluids, one of the fluids entering the heat exchanger at a lower temperature than the other fluid.

The exchanger 1 comprises an end plate 3 provided with an inlet opening 5 for the first fluid, with an inlet opening 7 for the second fluid, with an outlet opening for the first fluid and with an outlet opening for the second fluid 11 so that the first and second fluids can be introduced into and extracted from the exchanger.

The heat exchanger further comprises first 13 and second 15 heat-exchange modules which are superposed with one another along a longitudinal axis X. The first and second heat-exchange modules alternate with one another along the longitudinal axis. They each have a substantially parallelepipedal and slender shape that extends transversely with respect to the longitudinal axis X.

As a preference, each of the first 13 and second 15 heat-exchange modules have transversely extending faces 17 that are planar and parallel.

The exchanger further comprises partition plates 19 which are each positioned between adjacent first and second heat-exchange modules. Each partition plate is furthermore in contact with the first and second heat-exchange modules that are adjacent to it.

Each partition plate 19 extends transversely with respect to the longitudinal axis and preferably has faces that are planar and parallel.

The first and second heat-exchange modules each define a first fluid-circulation system 21 for the flow of the first fluid and a second fluid-circulation system 23 for the flow of the second fluid.

The heat exchanger further comprises a supply duct 25 supplying the first fluid-circulation system, and a supply duct 27 supplying the second fluid-circulation system so as to deliver the first and second fluids to the first and second fluid-circulation systems respectively.

The supply duct for the first fluid-circulation system and the supply duct for the second fluid-circulation system each open via one of their ends into the inlet opening 5 for the first fluid and into the inlet opening 7 for the second fluid.

The supply duct 25 for the first fluid-circulation system and the supply duct 27 for the second fluid-circulation system are formed for example by holes formed in the first heat-exchange modules and in the partition plates. They are shaped so as to be fluidically disconnected from one another in order to avoid mixing between the first and second fluids.

The heat exchanger further comprises a discharge duct 29 for the first fluid-circulation system, and a discharge duct 31 for the second fluid-circulation system so as to expel the first and second fluids from the first and second fluid-circulation systems respectively.

The discharge duct 29 for the first fluid-circulation system, and, respectively, the discharge duct 31 for the second fluid-circulation system fluidically connects the first fluid-circulation system and, respectively, the second fluid-circulation system, to the outlet opening 9 for the first fluid and, respectively, to the outlet opening 11 for the second fluid.

The supply and discharge ducts for the first fluid-circulation system and the supply and discharge ducts for the second fluid-circulation system are each formed for example by holes formed in the first and second heat-exchange modules and in the partition plates. They are configured in such a way as to form disconnected fluid-circulation paths between the inlet openings and outlet openings for each of the first and second fluids. In other words, the heat exchanger is configured such that the first and second fluids do not come into contact and do not mix with one another.

The supply and discharge ducts for the first fluid-circulation system and the supply and discharge ducts for the second fluid-circulation system furthermore open respectively into the first fluid-circulation system and into the second fluid-circulation system formed in each of the first and second heat-exchange modules respectively.

Moreover, each of the first heat-exchange modules is separated from the two heat-exchange modules adjacent to it on each side of the longitudinal axis by a partition plate 19 and vice versa.

That portion of each partition plate that is superposed with the first fluid-flow system and with the second fluid-flow system that are adjacent to it is solid. In this way, the partition plates 19 which sandwich a first heat-exchange module 13 and which are in contact with said heat-exchange module fluidically isolate the first fluid-circulation system 21 from the second fluid-circulation systems which are formed in the adjacent second heat-exchange modules 15, and vice versa.

Thus, during operation, the first and second fluids are introduced into the exchanger via the inlet opening 5 for the first fluid and via the inlet opening 7 for the second fluid, respectively. They flow respectively into the supply duct 25 of the first fluid-circulation system and into the supply duct 27 of the second fluid-circulation system. They then circulate through each of the first 21 and second 23 fluid-circulation systems respectively and exchange heat through the partition plate that is sandwiched by said systems. They are then collected by, respectively, the discharge duct for the first fluid-circulation system and the discharge duct for the second fluid-circulation system before leaving the exchanger via the outlet opening for the first fluid and the outlet opening for the second fluid, respectively.

Figure 2:
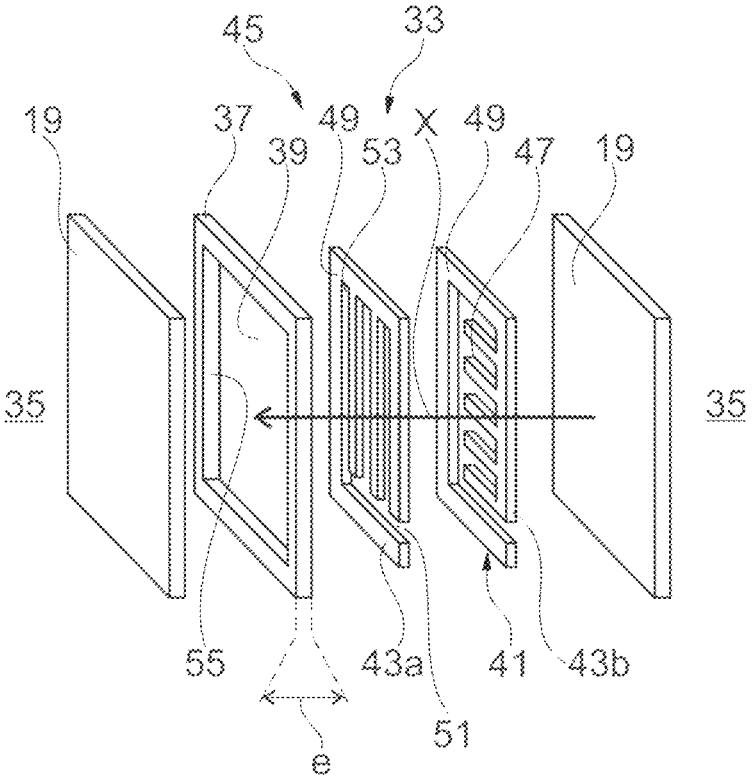
FIG. 2 and FIG. 3 schematically depict various exploded perspective views of various arrangements of the heat exchanger according to the invention.

FIG. 2 illustrates two embodiments of a heat-exchange module 33 which may be a first heat-exchange module 13 for the first fluid and/or a second heat-exchange module 15.

The heat-exchange module is placed between and in contact with two partition plates 19 which separate it longitudinally from the adjacent heat-exchange modules 35.

According to the exemplary embodiment illustrated in FIG. 2, the heat-exchange module 33 comprises a frame plate 37 which extends transversely to the longitudinal axis X.

The frame plate 37 has two faces which are planar and parallel.

It defines a through-aperture 39 that passes through the entire thickness of the frame plate. The aperture 39 is thus open onto the two opposite faces of the frame plate.

The heat-exchange module 33 further comprises an insert 41 which is wholly housed in the aperture. The insert 41 and the frame plate 37 have equal thicknesses e. Thus, the insert 41 and the frame plate 37 are both in contact via their opposite faces with the adjacent partition plates 19.

The insert 41 comprises at least one shaped plate 43.

According to a first embodiment, it comprises a single shaped plate 43 the thickness of which is equal to the thickness e of the frame plate. Such an embodiment is illustrated for example in FIGS. 9 to 13, which will be described later.

In a variant, illustrated in FIG. 2, the insert comprises a stack 45, along the longitudinal axis, of several shaped plates 43 one upon the other. In the example illustrated, it comprises two shaped plates, but it could comprise a higher number of them.

Moreover, the single shaped plate or each shaped plate of the stack has two faces that are planar and parallel. It further consists in at least one hollowed-out zone 47 surrounded, at least partially if not to say completely, by a surrounding solid zone 49.

Thus, the fluid-circulation system 50 of the heat-exchange module which, as applicable, is either the first 21 or the second 23 fluid-circulation system, is defined by the hollowed-out zone or zones 47 of the single shaped plate or of the stack. For example, in the example of FIG. 2, the shaped plate 43*a* comprises a hollowed-out zone 47 in the form of a main slot 51 and of parallel transverse secondary slots 53 which each extend from the one same side of the main slot 51. The other shaped plate 43*b* superposed with the shaped plate 43*a* has a pattern substantially identical to that of the shaped plate 43*a* except that it is rotated through an angle of 90° with respect to the longitudinal axis.

Thus, superposing the hollowed-out zones 47 and/or solid zones 49 of the shaped plates 43 of the plurality defines a fluid-circulation system having different circulation paths that extend into the thickness of and transversely within the insert.

Thus, the fluid system formed in the heat-exchange module 33 is bounded longitudinally by the mutually-facing faces of the opposing partition plates 19 that sandwich the heat-exchange module 33 and is bounded transversely by the solid zone or zones 49 of the shaped plate or plates 43 and also, optionally, by the lateral face 55 of the aperture 39 of the frame plate 37.

According to a second embodiment, the heat-exchange module 33 consists of at least one shaped plate 43 consisting of at least one hollowed-out zone 47 and a surrounding solid zone 49 fully surrounding the hollowed-out zone.

Figure 3:
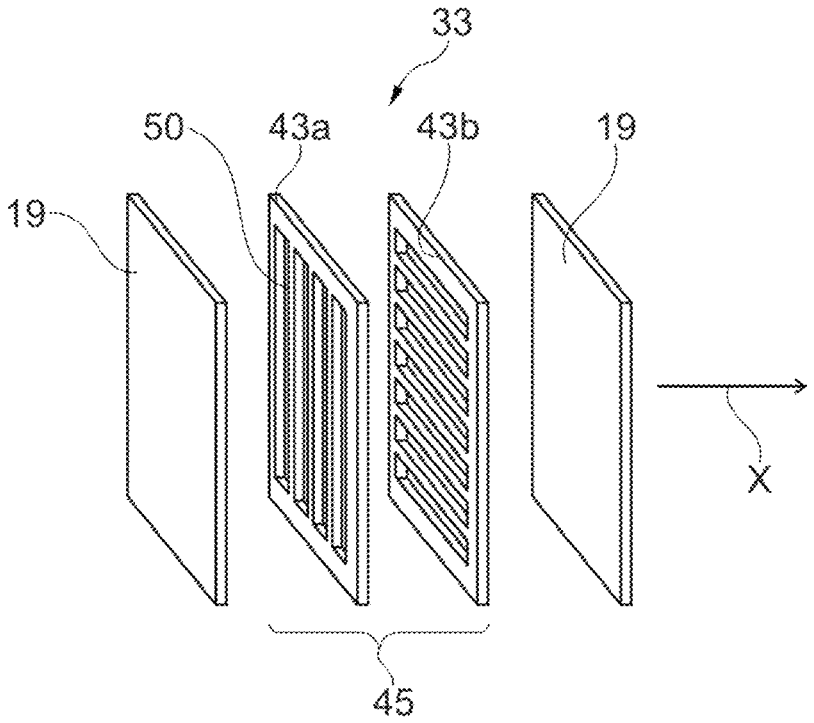

In the example illustrated in FIG. 3, the module 33 comprises a stack 45 of shaped plates 43*a-b* extending along the longitudinal axis. Thus, superposing the hollowed-out zones 47 and/or solid zones 49 of the shaped plates 43 of the stack defines a fluid-circulation system having different circulation paths that extend longitudinally and transversely within the heat-exchange module 33.

The heat exchanger 33 may comprise heat-exchange modules according to the first embodiment and/or according to the second embodiment. For example, all the heat-exchange modules are according to the first embodiment and all the second heat-exchange modules are according to the second embodiment, or vice versa.

Figure 4:
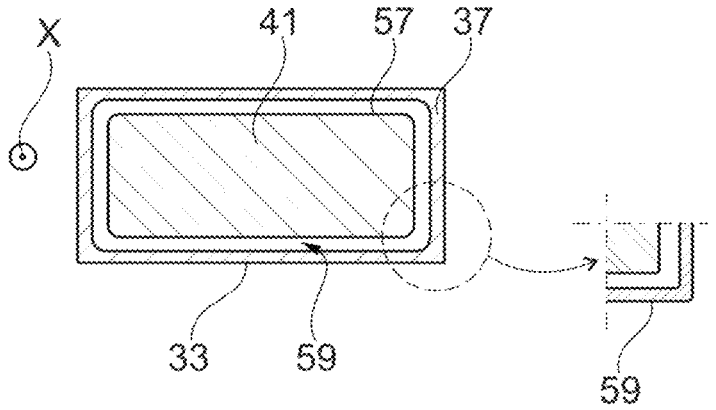
FIG. 4 illustrates in detail a heat-exchange module provided with a frame plate and with an insert.

Various means may be employed in order to improve the sealing of the fluid-circulation system. For example, a bead of adhesive may be applied to the mutually-facing faces of the shaped plate or plates and of the partition plates. The exchanger according to the first embodiment may comprise a groove 57, preferably of constant width, extending transversely between the insert 41 and the frame plate 37. A seal 59, preferably an O-ring, may be placed in the groove, as illustrated in FIG. 4. The seal may project longitudinally from the groove 57 so as to be compressed by the adjacent shaped plates and/or partition plates.

FIGS. 5A to 5D illustrate an example of a stack of a heat exchanger according to the second aspect of the invention.

The stack is formed of three shaped plates 43 arranged in such a way that the solid zone 49 of one plate is superposed with one of the hollowed-out zones 47 of at least one other of the plates of the stack, and vice versa.

Figure 5:
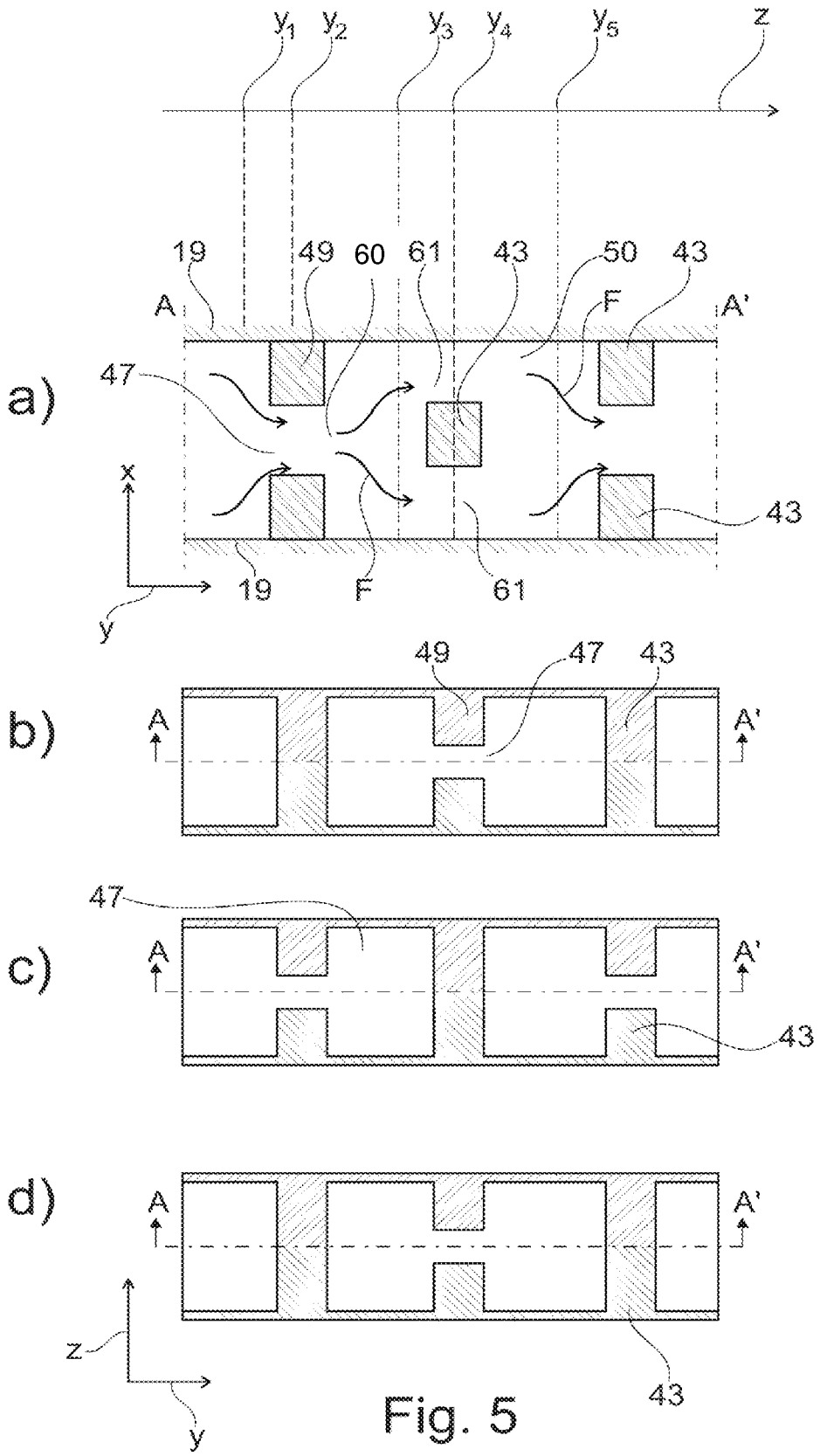
FIG. 5A is a schematic view on a longitudinal plane of section (AA') of a stack of shaped plates.
FIGS. 5B, 5C, and 5D are views of different shaped plates according to their rank in the stack.

FIG. 5 a) is a view of a longitudinal plane of section (AA) of the stack, defined by the longitudinal axis X and a transverse axis Z perpendicular to the axis X. As may be seen by perusing the stack along the transverse axis, the superposition of the solid zones 49 and hollowed-out zones 47 defines a fluid-circulation system 50 the profile of which varies according to the position along the transverse axis Y. For example, at the abscissa value $Y_1$, the hollowed-out zones of the three shaped plates are superposed with one another and the circulation system extends entirely between the two opposing partition plates 19. At the abscissa value $Y_2$, the hollowed-out zone of the intermediate shaped plate is superposed with the solid zones of the shaped plates that are superposed with it. The profile of the fluid-circulation system thus evolves from a profile with a great thickness to a profile of a lesser thickness. At the abscissa value $Y_3$, the fluid-circulation system has a profile identical to the profile of the abscissa value $Y_1$. At the abscissa value $Y_4$, hollowed-out zones of the lower and upper shaped plates are superposed with the solid zone of the intermediate shaped plate. Thus, the system comprises a main path 60 which splits into secondary paths 61 which recombine downstream at the abscissa value $Y_5$, as indicated by the arrows F.

The fluid-circulation system 50 thus comprises portions which extend into the thickness of the stack and which are extended by portions that extend parallel to the median plane of the stack.

FIGS. 5B to 5D depict each of the lower, intermediate and upper shaped plates, observed along the longitudinal axis. As may be seen, the variation in profile of the fluid system will also include the variation in width, measured along the axis Z perpendicular to the longitudinal axis X and transverse axis Y of the fluid system, which furthermore comprises portions which extend along axes different than the median plane of the stack.

In this way, a three-dimensional and complex circulation of the fluid flowing in the heat-exchange module can be obtained. It is thus possible to vary the fluidic conditions of the flow of the fluid by locally changing the shape of the fluid-circulation system.

Figures 6A, 6B, 6C:
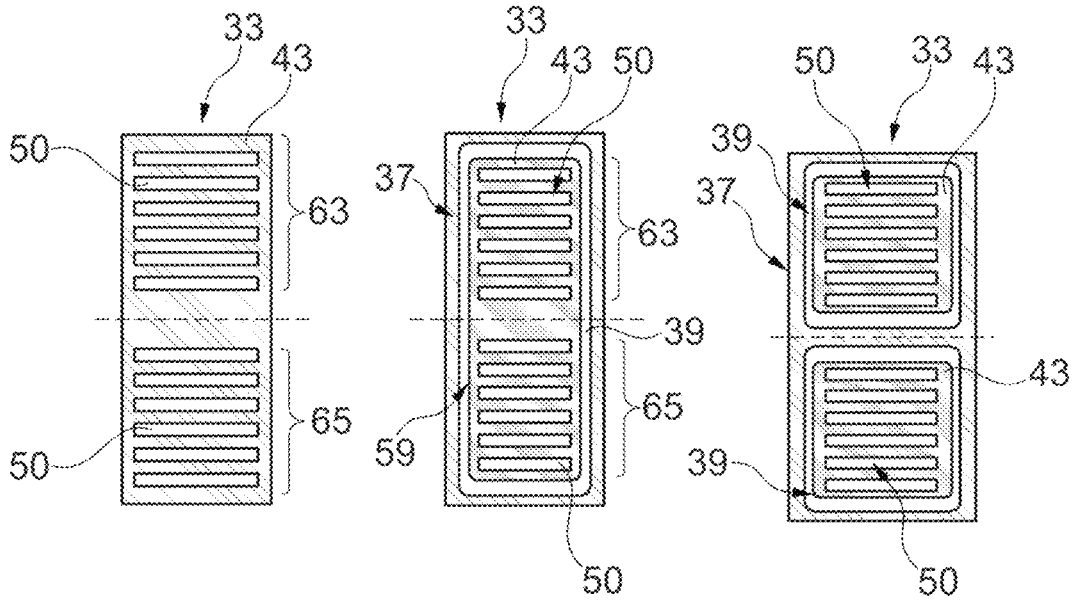
FIGS. 6A, 6B, and 6C schematically illustrate various examples of arrangements of shaped plates and/or of frame plates.
Figure 7:
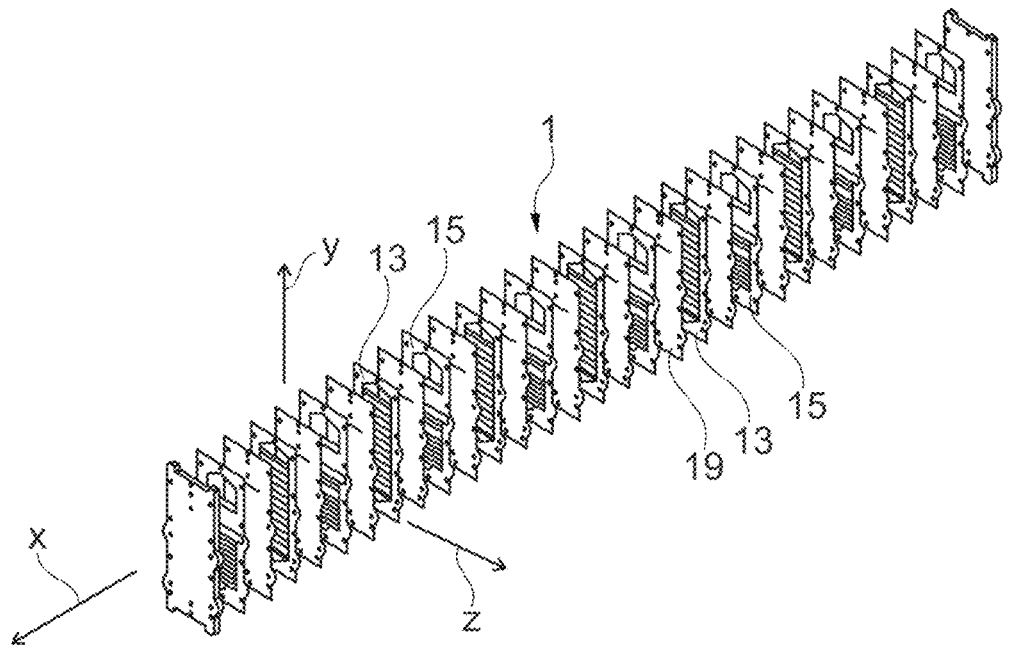
FIG. 7 is an exploded perspective view of one exemplary embodiment of the heat exchanger according to the invention.
Figure 8:
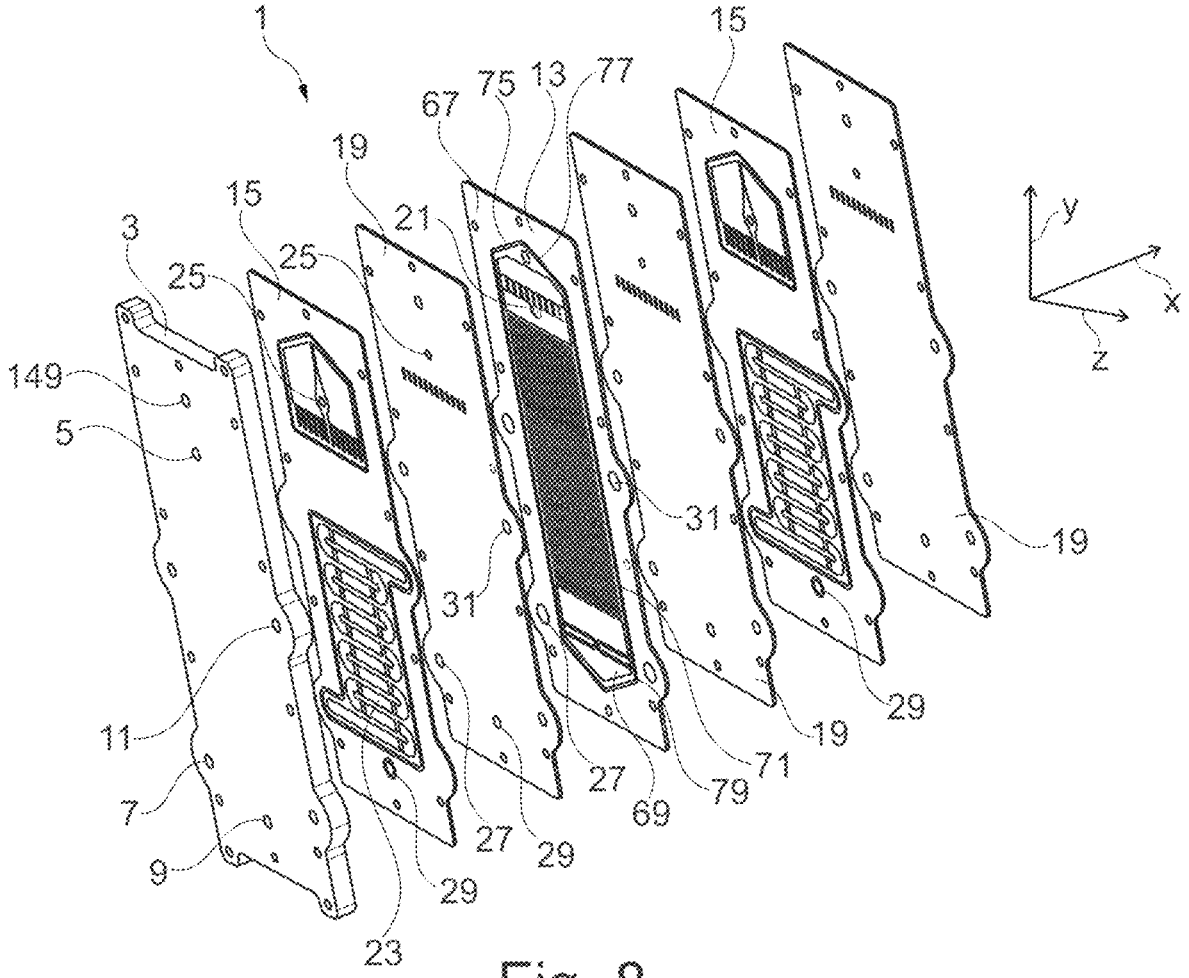
FIG. 8 is a perspective view of a first heat-exchange module and of a second heat-exchange module which are adjacent and separated by partition plates.
Figure 9:
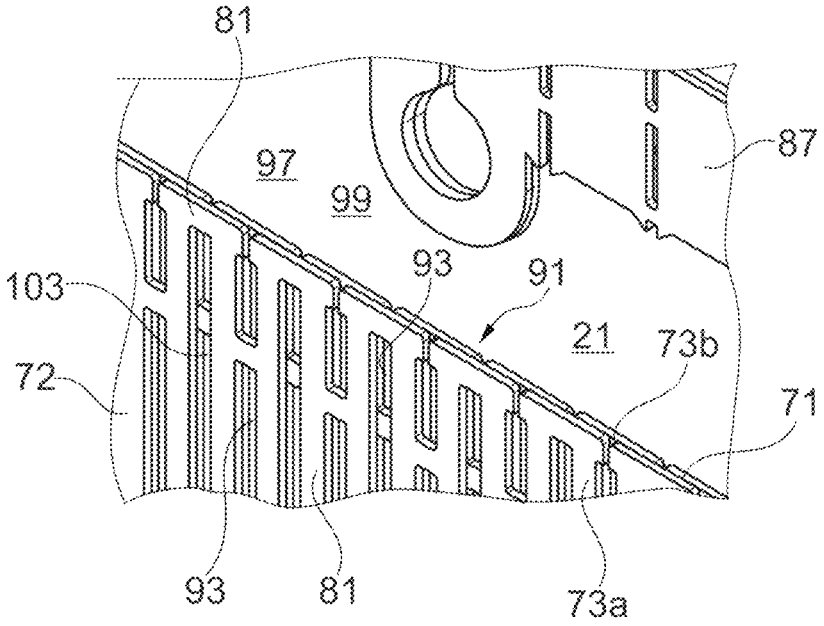
FIG. 9 and FIG. 10 are, respectively, enlarged views of the first and second heat-exchange modules of the exchanger illustrated in FIG. 8.

FIGS. 6A, 6B, and 6C depict embodiments in which the heat-exchange module 33 may define a plurality of fluid-circulation systems 50. For example, in FIGS. 6A and 6B, this is obtained by contriving for different portions 63, 65 of a shaped plate 43 to be serviced by different supply and discharge ducts. In FIG. 6C, the frame plate 37 comprises two apertures 39 in which two respective shaped plates 43, for example for the flow of two different fluids within the same heat-exchange module, are housed. Other examples similar to that illustrated in FIG. 6C are illustrated in FIGS. 7 to 13.

FIGS. 7 to 13 depict another example of a heat exchanger 1 according to the invention, suitable for separating, under the effect of the exchange of heat between the first and second fluids, first and second fluid components that make up the first fluid.

It comprises a plurality of identical first heat-exchange modules 13, and a plurality of identical second heat-exchange modules 15 extending along a vertical axis Y. The first and second heat-exchange modules are arranged so that they alternate with one another along the longitudinal axis X, which is horizontal.

Identical partition plates 19 are furthermore placed between each pair of first and second modules. Finally, it comprises two end plates 3, one at each longitudinal end, and clamping means, not illustrated, which compress the superposition of the first and second heat-exchange modules and partition plates longitudinally.

The first heat-exchange module 13 comprises a frame plate 67 provided with a through-aperture 69 in which an insert 71 is placed. The insert 71 is formed of a stack 72, along the longitudinal axis, of two shaped plates 73*a-b*, as is more particularly visible in FIG. 9. The stack 72 and the frame plate 67 have equal thicknesses.

The insert 71 has an exterior contour 75 which is homothetic with respect to the lateral contour 77 of the aperture, so that it lies at a constant distance from the contour of the aperture. A groove 79 is thus bounded between the insert and the frame plate.

The two shaped plates 73*a-b* are identical.

Each shaped plate 73*a-b* has a perpendicular overall shape extended at its two lengthwise ends by parts of triangular shape. It comprises a solid zone 81 which comprises a frame 83 defining a lateral wall of the shaped plate. The solid zone 81 further comprises a lower band 85 and an upper band 87 which bands each extend between two opposite lateral edges 89 of the shaped plate, and a central portion 91 which represents more than 70% of the area of the solid zone. A "lower" structure is positioned at a lower height along the vertical axis Y than an "upper" structure. The central portion 91 is positioned between the lower band 85 and upper band 87. It encompasses a plurality of hollowed-out zones 93 in the form of parallel straight slots extending along the length of the shaped plate.

Moreover, each shaped plate 73*a-b* defines lower 95 and upper 97 hollowed-out zones on each side of the central portion, along the length of the frame plate. These lower and upper hollowed-out portions each represent more than 10% of the area of the shaped plate. They extend from one lateral edge 89 to the other. Superposing the lower and upper hollowed-out zones of, respectively, the two shaped plates in the stack, thus defines a distribution chamber 99 for the first fluid and a collecting chamber 101 for the first fluid, respectively.

Each shaped plate 73*a-b* is asymmetric in a median longitudinal plane. The plates are arranged relative to one another in such a way that one is the image of the other through a rotation by 180° about a vertical transverse axis Y' parallel to the length direction of said shaped plates.

Thus, superposing said shaped plates 73*a-b* defines a complex fluid-circulation path made up of parallel channels 103 extending along the length of the insert and taking a sinuous route into the thickness of the insert, slots of one of the shaped plates being superposed with the central portion of the other shaped plate, and vice versa. Each channel 103 is supplied upstream via the distribution chamber 99 for the first fluid and opens at its downstream end into the collecting chamber 101 for the first fluid.

Moreover, in order to render the flow of the first fluid leaktight, the first module comprises a seal 59 placed in the groove.

Figure 12:
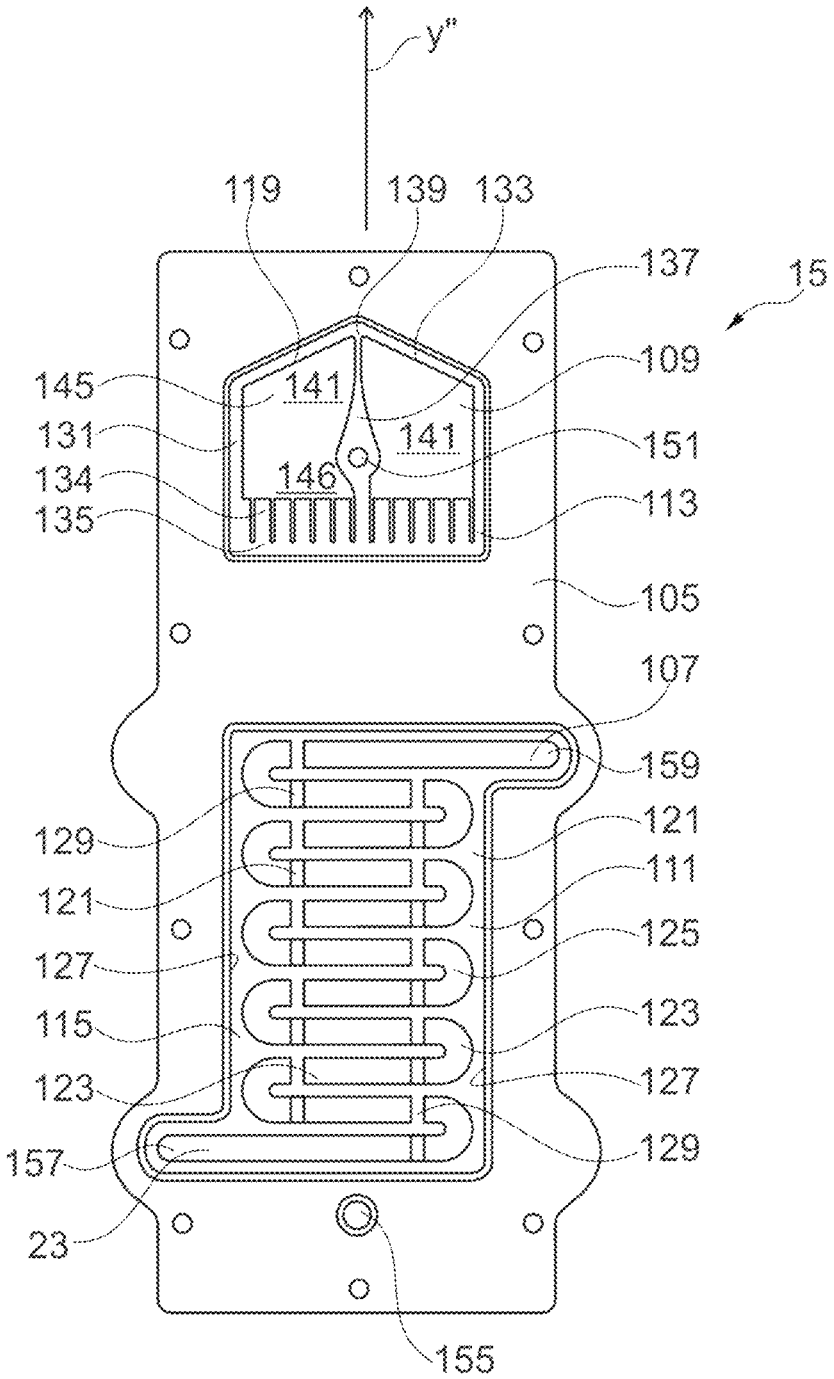
Figure 13:
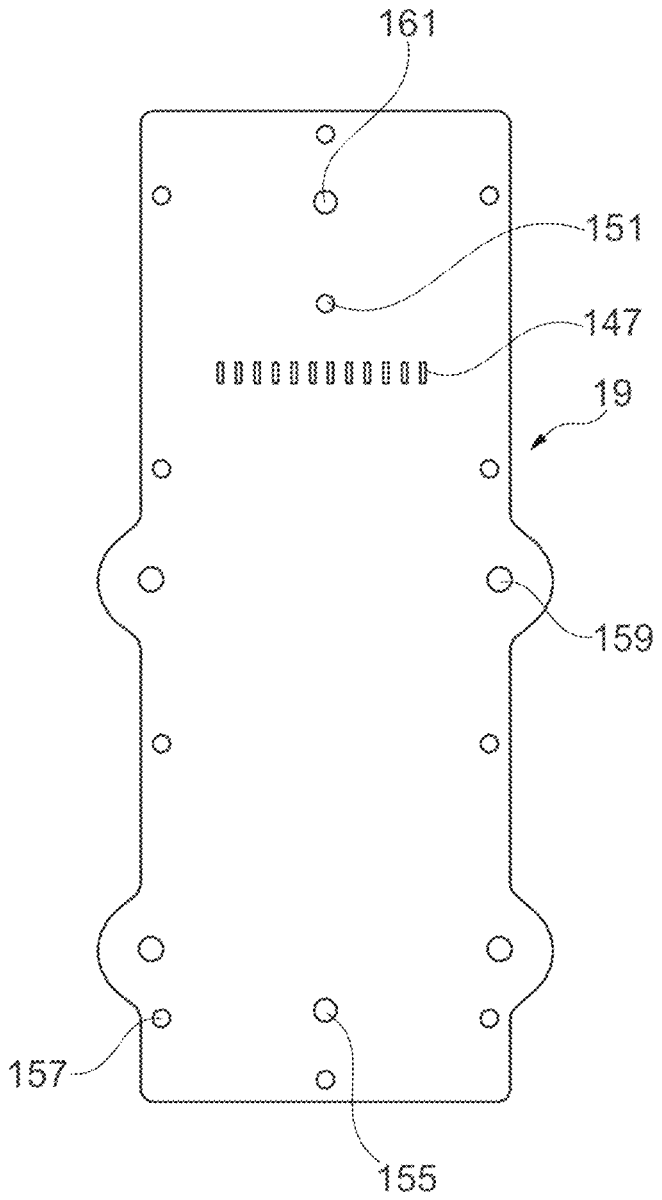
Figure 14:
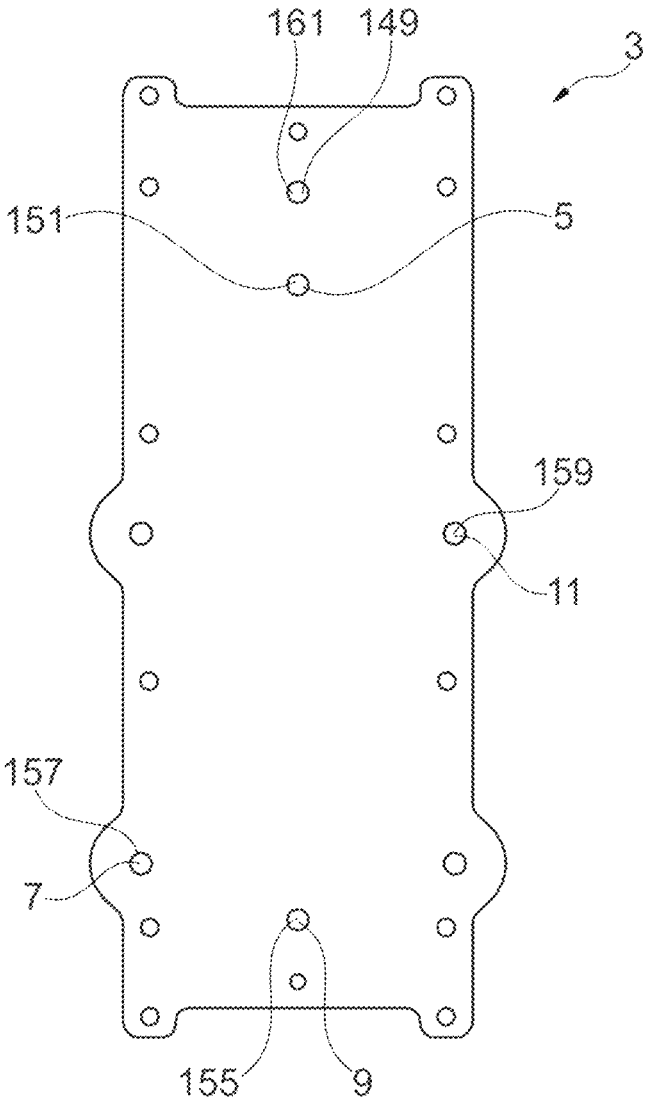

The second heat-exchange module 15, illustrated in FIG. 12, is different than the first heat-exchange module 13.

It comprises a frame plate 105 provided with two through-apertures 107, 109 separate from one another with two inserts 111, 113 placed in a respective one of them.

Figure 10:
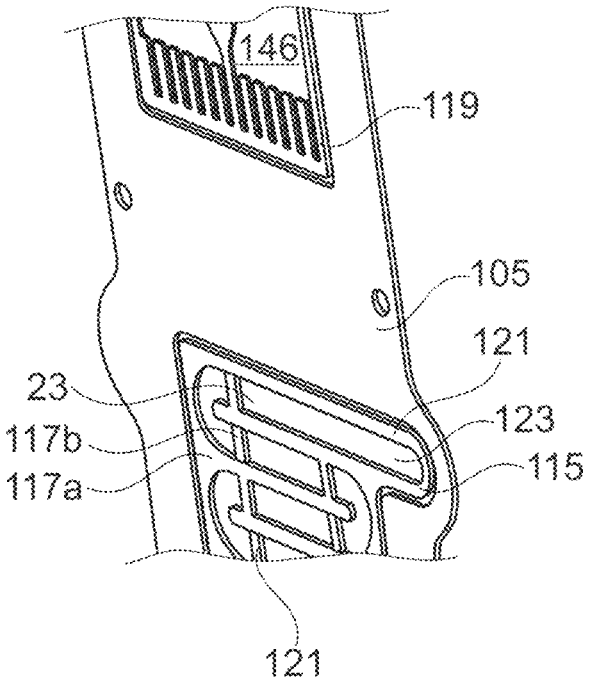
Figure 11:
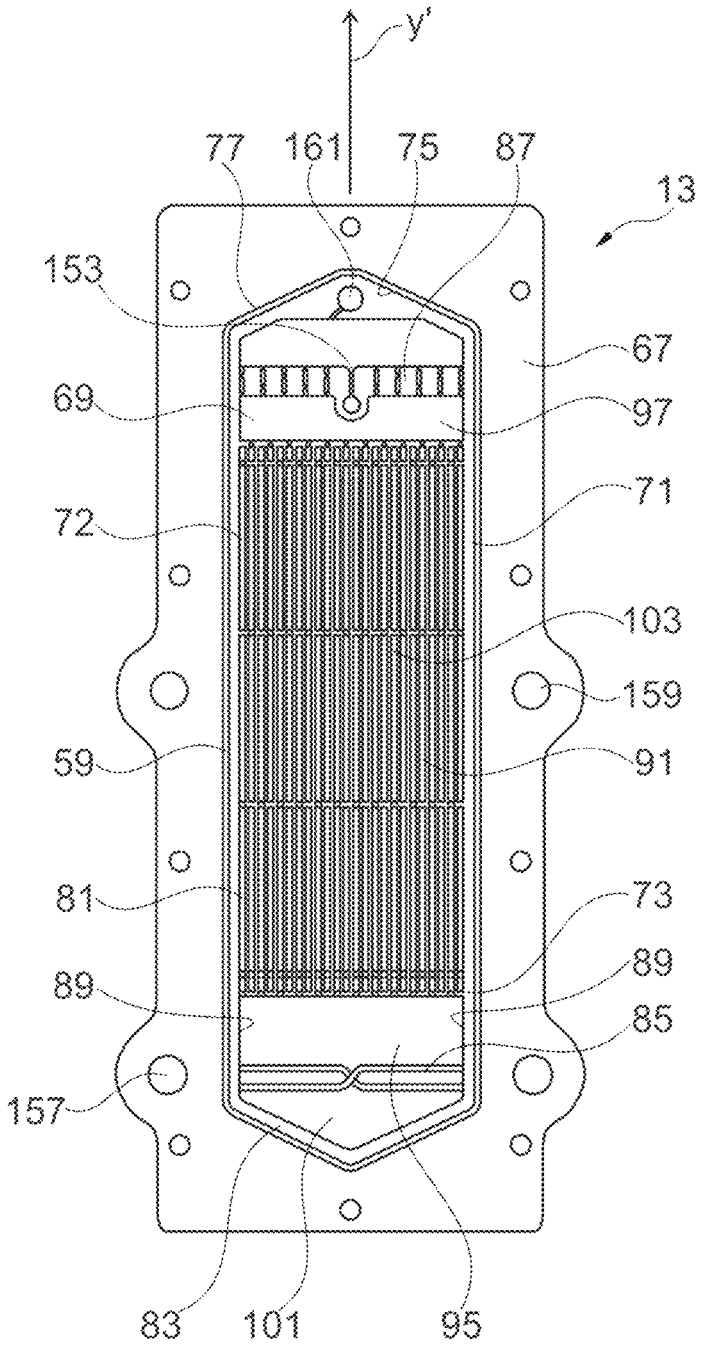
FIG. 11, FIG. 12, FIG. 13 and FIG. 14 are views along the longitudinal axis of a first heat-exchange module, of a second heat-exchange module, of a partition plate, and of an end plate of the heat exchanger illustrated in FIGS. 9 and 10.

The first insert 111 is formed of a longitudinal stack 115 of two shaped plates 117*a-b*, and the second insert 113 consists of a single shaped plate 119, as is more particularly visible in FIG. 10.

The first 111 and second 113 inserts have the same thickness as the frame plate 105.

The first and second inserts are each homothetic with respect to the contours of the apertures in which they are placed and are each separated from the surrounding aperture by a groove in which an O-ring seal is placed.

The shaped plates 117*a-b* of the first insert 111 are identical and asymmetric. They are arranged relative to one another in such a way that one is the image of the other through a rotation by 180° about a vertical transverse axis Y" parallel to the length direction of said frame plates. Each shaped plate 117 consists of a surrounding solid zone 121 which encompasses hollowed-out zones 123 which together delimit a serpentine slot 125 which extends between two transverse edges 127 of the shaped plate. The slot is interrupted by reinforcers 129 running transversely with respect to the axis along which the slot 125 extends. The slots of the two shaped plates 117*a-b* are superposed on one another thus defining a second fluid-circulation system 23, in the form of a channel, for the flow of the second fluid. Furthermore, the transverse reinforcers 129 superposed on a hollowed-out zone of the other shaped plate, cause the flow of the second fluid to deviate into the thickness of the stack 115.

The second insert 113 consists of a pentagonal shaped plate 119 of a thickness equal to the thickness of the frame plate 105. The shaped plate comprises a solid zone 131, the area of which is less than 20% of the area covered by the shaped plate. The solid zone 131 further comprises an exterior frame 133 and fingers 134 extending out from an edge 135 of the exterior frame 133, perpendicular to the latter and parallel to one another. It further comprises a tie 137 which connects said edge 135 to an opposite vertex 139 of the pentagon. The solid zone 131 thus surrounds two hollowed-out zones 141 which define a third fluid-circulation system 145, which may be a bypass chamber 146 as will become apparent later.

Each partition plate 19 which separates adjacent first 13 and second 15 heat-exchange modules comprises pierced holes 147 passing through its entire thickness and placing the third fluid-circulation system 145 in fluidic communication with the first fluid-circulation system 21. The pierced holes take the form of slits which are superposed with the spaces between the fingers 133 of the insert 113 and with the distribution chamber 99 of the first fluid-circulation system.

Moreover, one of the end plates 3 comprises an inlet opening 5 for the first fluid and an outlet opening 9 for the first fluid so that the first fluid can be introduced into, and the first fluid component can be extracted from, the exchanger, as will be described hereinafter. It further comprises an inlet opening 7 for the second fluid and an outlet opening 11 for the second fluid so that the second fluid can be introduced into and extracted from the heat exchanger. It finally comprises an outlet opening 149 for the second fluid component so that the second fluid component can be extracted from the exchanger. In a variant which has not been illustrated, one or a plurality of the aforementioned inlet openings and/or outlet openings may be located on the other end plate.

The inlet opening 5 for the first fluid is extended by a supply duct 151 of the first fluid-circulation system 21 which opens into the distribution chamber 99 of the first fluid-circulation system.

The supply duct 151 of the first fluid-circulation system is delimited by the repeating assembly formed from the longitudinal superposition of a through-hole formed in the end plate which opens onto the inlet opening for the first fluid, of a through-hole pierced in the tie of the shaped plate of the second insert of the second heat-exchange module, of a through-hole formed in the partition plate, and of a through-hole formed in the insert of the first heat-exchange module. This assembly is repeated longitudinally so that all the first heat-exchange modules 13 are supplied with first fluid in parallel.

The insert 71 of the first heat-exchange module 13 comprises a notch 153 formed in the upper band and fluidically connecting the supply duct of the first fluid-circulation system to the distribution chamber for the first fluid.

The outlet opening 9 for the first fluid is extended by a discharge duct 155 of the first fluid-circulation system 21 which opens into the collecting chamber 101 of the first fluid-circulation system.

The discharge duct 155 of the first fluid-circulation system is delimited by the repeating assembly formed from the longitudinal superposition of a through-hole formed in the end plate which opens onto the outlet opening for the first fluid, of a through-hole pierced in the frame plate of the second heat-exchange module, and of a through-hole formed in the partition plate. This assembly is repeated longitudinally so that all the first heat-exchange modules have their first fluid expelled in parallel.

Moreover, the supply duct of the second fluid-circulation system opens into the second fluid-circulation system. It is delimited by the superposition of an assembly formed from the longitudinal superposition of a through-hole formed in and at the periphery of the end plate and which opens onto the inlet opening for the second fluid, and, where applicable, of a through-hole pierced in the frame plate of the first heat-exchange module, and of a through-hole formed in the partition plate. This assembly is repeated longitudinally so that all the second heat-exchange modules are supplied with second fluid in parallel.

The inlet opening 7 for the second fluid is extended by a supply duct 157 of the first fluid-circulation system 21.

The supply duct 157 of the second fluid-circulation system opens into the second fluid-circulation system 23. It is delimited by repeats of an assembly formed from the longitudinal superposition of a through-hole formed in and at the periphery of the end plate 3 and which opens onto the inlet opening for the second fluid 7, and, where applicable, of a through-hole pierced in the frame plate of the first heat-exchange module, and of a through-hole formed in the partition plate. This assembly is repeated longitudinally so that all the second heat-exchange modules are supplied with second fluid in parallel.

The outlet opening 11 for the second fluid is extended by a discharge duct 159 of the second fluid-circulation system 23.

The discharge duct 159 of the second fluid-circulation system opens into the second fluid-circulation system 23. It is delimited by repeats of an assembly formed from the longitudinal superposition of a through-hole formed in and at the periphery of the end plate 3 and which opens onto the outlet opening for the second fluid 11, and, where applicable, of a through-hole pierced in the frame plate of the first heat-exchange module, and of a through-hole formed in the partition plate 19. This assembly is repeated longitudinally so that all the second heat-exchange modules have their second fluid expelled in parallel.

Finally, the outlet opening 149 for the second fluid component is extended by a discharge duct 161 of the third fluid-circulation system 145.

Finally, the discharge duct 161 of the third fluid-circulation system opens into the third fluid-circulation system. It is delimited by the superposition of an assembly formed from the longitudinal superposition of a through-hole formed in the end plate and which opens onto the outlet opening for the second fluid component, and, where applicable, of a through-hole pierced in the insert of the first heat-exchange module, and of a through-hole formed in the partition plate. This assembly is repeated longitudinally so that all the second heat-exchange modules have their second fluid component expelled in parallel.

One example of implementation of the exchanger illustrated in FIGS. 7 to 14 is set out hereinbelow, in which example the exchange of heat is between a cold first fluid and a hot second liquid in countercurrent flow.

The first fluid comprises a first fluid component, for example water, and a second fluid component, for example ammonia. As it enters the exchanger, the first fluid is fully liquid.

During the exchange of heat, the first fluid enters the heat exchanger via the first-fluid inlet 5. It flows in the supply duct 151 of the first fluid-circulation system then enters the distribution chamber 99 of the first heat-exchange module 21 where it is distributed between the various parallel channels 103 of the central portion 91 toward the collecting chamber 101.

The second fluid flows countercurrent to the first fluid. It enters the heat exchanger via the second-fluid inlet 7 and flows in the second-fluid supply duct 157. It then enters the second heat-exchange module 23 where it circulates in the second fluid-circulation system in the form of a serpentine as far as the discharge duct of the second fluid-circulation system.

The first fluid and the second fluid exchange heat in those portions of the first and second fluid-circulation systems that are longitudinally superposed and fluidically disconnected by the partition plate 19 that separates them.

The quantity of heat supplied to the first fluid is sufficient to bring about a phase transformation, from the liquid state to the gaseous state, of only the second fluid component. For example, within the first fluid, the ammonia passes from the liquid state to the gaseous state and the water remains in the liquid state.

The first fluid component accumulates in the collecting chamber 101 before being discharged via the outlet opening 9 of the second fluid-circulation system.

The second fluid component in the gaseous state flows countercurrent in the first circulation system under the effect of Archimedean upthrust in the central portion 91 of the first fluid-circulation system. The flow of the second fluid component is constrained by the volume of the first fluid contained in the first-fluid distribution chamber 99. The second fluid component is therefore diverted through the slits 147 in the partition plate and enters the bypass chamber 146 in the second heat-exchange module. The bypass chamber 146 is thus able to collect the second fluid component by bypassing the first-fluid distribution zone 99 so that it can be extracted from the second heat-exchange module via the discharge duct of the third fluid system leading to the corresponding outlet opening.

Figure 15:
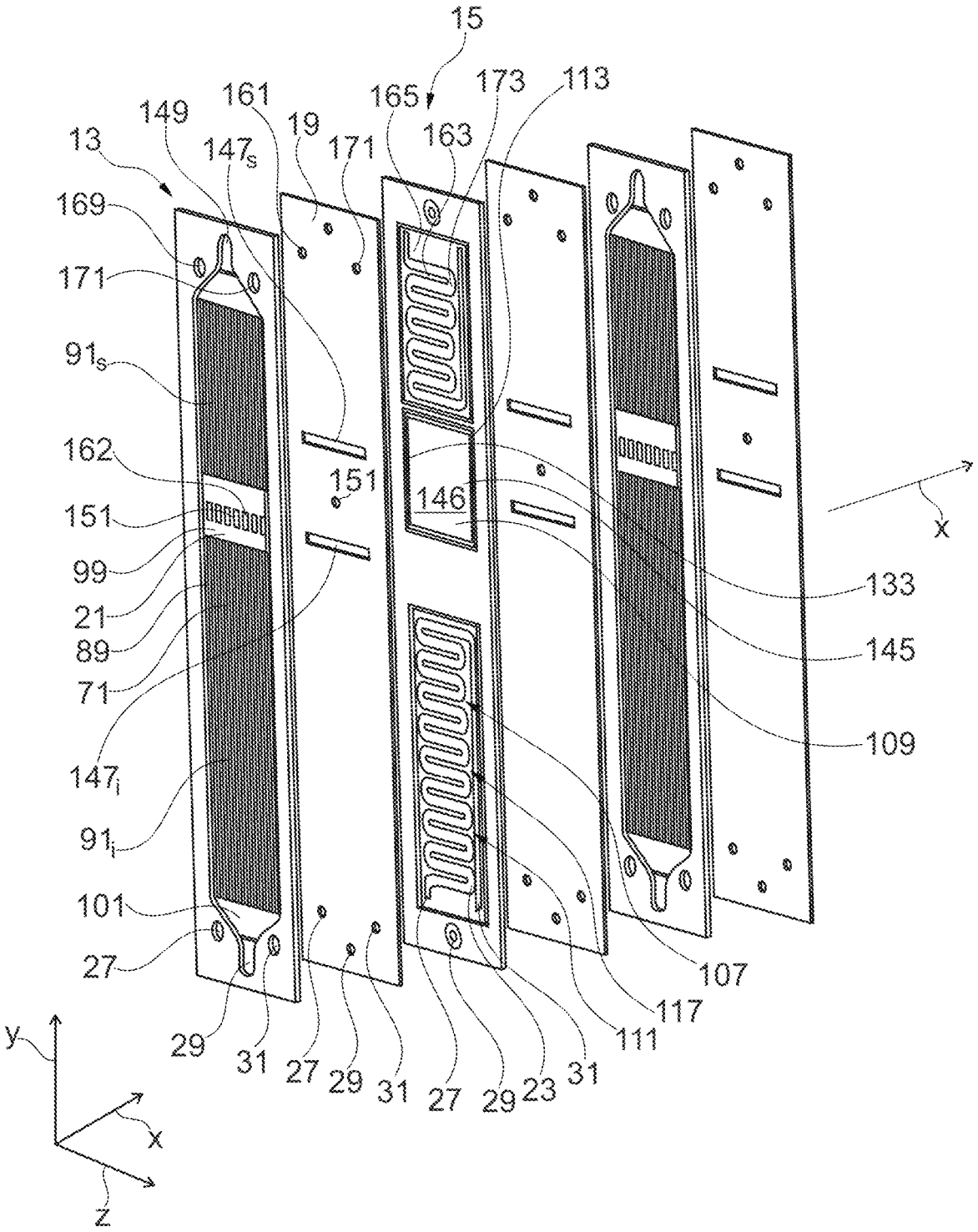
FIG. 15 is an exploded perspective view of another embodiment of a heat exchanger according to the invention.

Finally, FIG. 15 illustrates another example of a heat exchanger which differs from that illustrated in FIGS. 7 to 14 through the following features.

Each shaped plate 73 of the insert 71 of the first heat-exchange module 13 comprises a central band 162 extending between two opposite lateral edges 89 of the shaped plate. The central band has a hole via which the supply duct 151 for the first fluid opens into the first fluid-circulation system 21.

Each shaped plate further comprises a central portion 91 which is interrupted by a first-fluid distribution chamber in which the central band. Thus, the central band is positioned between and some distance from a lower part $\mathbf{91}_i$ and an upper part $\mathbf{91}_s$ of the central portion 91. A distribution chamber 99 for the first fluid is defined between the central band and the lower central portion $\mathbf{91}_i$.

The second heat-exchange module 15 comprises a first 107, a second 109 and a third 163 aperture respectively accommodating a first 111, a second 113 and a third 165 insert.

The first 107 and third 163 apertures are positioned one on each side of the second aperture 109.

The second fluid-circulation system 23 is formed by the first insert 111 which is a single shaped plate 117 comprising a hollowed-out zone in the form of a serpentine which extends between the supply duct 27 and discharge duct 31 of the second fluid-circulation system. In a variant, the second fluid-circulation system may be defined by a stack of shaped plates as described in FIGS. 7 to 14.

The second insert 113 is a rectangular and perforated shaped plate 119 which has an exterior frame 133 delimiting a bypass chamber 146, superposed with the distribution chamber 99 for the first fluid and with lower $\mathbf{147}_i$ and upper $\mathbf{147}_s$ through-slits formed in the partition plate 19.

The third insert 165 is a shaped plate 167 having a hollowed-out zone in the form of a serpentine which thus defines a fourth fluid-circulation system 173. The frame plate 67 of the first heat-exchange module 13 and the partition plate 19 have superposed through-holes which define supply 169 and discharge 171 ducts for a fluid flowing in the fourth fluid-circulation system.

One implementation of the heat exchanger illustrated in FIG. 15 is described below.

A first fluid, being a mixture of a first fluid component, for example liquid water, and of a second fluid component, for example liquid ammonia, is introduced into the first fluid-circulation system 21 via the supply duct 151, where it is distributed in the distribution chamber 99 and then flows, under the effect of gravity, toward the collecting chamber 101. A second fluid, hotter than the first fluid, is circulated countercurrent in the second fluid-circulation system 23 in between the corresponding inlet 27 and discharge 29 ducts. The first fluid therefore becomes heated under the effect of the heat transfer with the second fluid, causing a change in phase of the second fluid component, for example causing the ammonia to vaporize. The second fluid component therefore rises up inside the lower part $\mathbf{91}_i$ of the central portion, countercurrent to the flow of the first fluid. Its flow is then blocked by the first fluid contained in the distribution chamber 99. It is therefore diverted through the lower slit $\mathbf{147}_i$ into the bypass chamber 146.

The second fluid component then rises up through the bypass chamber 146 and passes back through the partition plate 19, through the upper slit $\mathbf{147}_s$. It then flows in the upper part $\mathbf{91}_s$ of the central portion toward the outlet opening 149 for the second fluid component so that the second fluid component can be extracted from the exchanger.

A fluid, for example identical to the second fluid, and colder than the second fluid component is circulated, countercurrent to the second fluid component, in the fourth fluid-circulation system 173, between the supply duct 169 and discharge duct 171 of the fourth fluid-circulation system. The second fluid component is thus cooled as it flows between the third fluid-circulation system 145 and the outlet 149 for the second fluid component.

When the second fluid component transitions to the gaseous state in the lower portion $\mathbf{91}_i$, it is possible that a small quantity of the first fluid will also transition to that same gaseous state. Advantageously, the cooling by exchange of heat with the fluid circulating in the fourth fluid system 173 causes the first fluid component to condense, thus separating it from the second fluid component. The first fluid component then circulates back in the liquid state under the effect of gravity through the upper part $\mathbf{91}_s$ and then the lower part $\mathbf{91}_i$ of the central portion as far as the first-liquid collecting chamber 101.

The second fluid component, for example ammonia, thus separated has a high degree of purity.

Other variants and refinements may be envisioned without thereby departing from the scope of the invention as defined by the claims.

The invention claimed is:

1. A heat exchanger comprising, superposed longitudinally on one another:

a plurality of first and second heat-exchange modules in which first and second fluid-circulation systems are formed, for circulating first and second fluids respectively, and a plurality of partition plates, each sandwiched between adjacent first and second heat-exchange modules and in contact with the adjacent first and second heat-exchange modules, each partition plate fluidically disconnecting the first and second fluid-circulation systems from one another, at least one of the first and second heat-exchange modules comprising:

a frame plate of constant thickness, comprising an aperture passing through its entire thickness, and an insert fully housed in the aperture and of a thickness equal to the thickness of the frame plate, the insert consisting of a) a shaped plate consisting of at least one hollowed-out zone passing through the entire thickness of the shaped plate and of a surrounding solid zone of constant thickness, the corresponding fluid-circulation system being formed in the hollowed-out zone and bounded transversely by the surrounding solid zone and longitudinally by the partition plates adjacent to the module, or b) a stack of shaped plates, at least one of the shaped plates consisting of at least one hollowed-out zone passing through the entire thickness of the shaped plate and of a surrounding solid zone of constant thickness, the corresponding fluid-circulation system being defined by the hollowed-out zones of the stack and bounded transversely by the surrounding solid zones and longitudinally by the partition plates adjacent to the corresponding heat-exchange module.

2. The heat exchanger as claimed in claim 1, the hollowed-out zone being formed by cutting.

3. The heat exchanger as claimed in claim 1, the contour of the aperture and the exterior contour of the insert, in at least a transverse plane of section, being homothetic with respect to one another.

4. The heat exchanger as claimed in claim 1, having a groove separating the frame plate and the insert from one another.

5. The heat exchanger as claimed in claim 4, comprising a seal placed in the groove and which is compressed by the adjacent partition plates.

6. The heat exchanger as claimed in claim 1, the shaped plate or plates and/or the partition plate and/or the frame plate being planar and having parallel faces.

7. The heat exchanger as claimed in claim 1, at least part of the hollowed-out zone of one of the shaped plates of the stack being superposed with a solid zone of another shaped plate adjacent to it in the stack, and vice versa.

8. The heat exchanger as claimed in claim 1, the fluid-circulation system having, in at least a longitudinal plane of section, different profiles at least at two different positions along the transverse axis of the plane of section, which is perpendicular to the longitudinal axis.

9. The heat exchanger as claimed in claim 8, the profile at a position along the transverse axis being the rank of the hollowed-out zone or zones in the stack and/or the height of the fluid-circulation system at the position and/or the number of hollowed-out zones at the position.

10. The heat exchanger as claimed in claim 1, the stack comprising at least two identical shaped plates.

11. The heat exchanger as claimed in claim 10, the identical shaped plates each being asymmetrical, one of the shaped plates being arranged symmetrically with the other shaped plate, with respect to a longitudinal plane.

12. The heat exchanger as claimed in claim 1, the shaped plates each having a thickness less than 3 mm.

13. The heat exchanger as claimed in claim 1, the frame plate and the shaped plate or plates being made of different materials.

14. The heat exchanger as claimed in claim 1, the second heat-exchange module comprising a third fluid-circulation system fluidically disconnected from the second fluid-circulation system, the second and third fluid-circulation systems being defined by different portions of the hollowed-out zone or zones of the corresponding insert.

15. The heat exchanger as claimed in claim 1, the second heat-exchange module comprising a third fluid-circulation system fluidically disconnected from the second fluid-circulation system, the corresponding frame plate comprising a second aperture in which there is placed a second insert which bounds the third fluid-circulation system.

* * * * *